United States Patent [19]

Edgley et al.

[11] Patent Number: 4,978,315

[45] Date of Patent: Dec. 18, 1990

[54] MULTIPLE-CONDUCTOR ELECTRICAL CONNECTOR AND STAMPED AND FORMED CONTACTS FOR USE THEREWITH

[75] Inventors: Richard R. Edgley, Elmhurst; Frederick J. Gierut, Tinley Park; William Lenz, Crestwood, all of Ill.

[73] Assignee: Molex Incorporated, Lisle, Ill.

[21] Appl. No.: 506,971

[22] Filed: Apr. 10, 1990

[51] Int. Cl.[5] ..... H01R 4/24

[52] U.S. Cl. ..... 439/441; 439/499; 439/516

[58] Field of Search ..... 439/438, 439, 440, 441, 439/885, 861, 862, 266–270, 492, 499, 516

[56] References Cited

U.S. PATENT DOCUMENTS

| | | | |
|---|---|---|---|
| 3,596,235 | 7/1971 | Teurlings | 439/907 |
| 3,902,776 | 9/1975 | Williams et al. | 439/885 |
| 4,133,595 | 1/1979 | Pritulsky | 439/441 |
| 4,354,729 | 10/1982 | Grabbe et al. | 439/862 |
| 4,367,006 | 1/1983 | Rehbogen, Jr. et al. | 439/636 |
| 4,781,612 | 11/1988 | Thrush | 439/630 |

FOREIGN PATENT DOCUMENTS

| | | | |
|---|---|---|---|
| 0305597 | 3/1989 | European Pat. Off. | 439/885 |

*Primary Examiner*—David L. Pirlot

*Attorney, Agent, or Firm*—Louis A. Hecht; Stephen Z. Weiss; Charles S. Cohen

[57] ABSTRACT

A multi-conductor electrical connector for mounting on a printed circuit board which includes two rows of staggered insertion holes. The connector includes a housing having an elongate cavity. A contact strip is formed with a continuous carrier and laterally extending contacts gang-mountable in the elongate cavity of the housing. Each contact includes a conductor receptacle positionable in the cavity, and a pair of laterally spaced terminal tails projecting through the housing from the cavity. The terminal tails are independently severable whereby a terminal tail of any contact can be inserted into a hole in either row of staggered insertion holes in the printed circuit board. The contact receptacle is formed by an anvil portion and a spring finger portion. The terminal tails are stamped and formed out of the anvil portion and the spring finger portion of the contact.

13 Claims, 2 Drawing Sheets

MULTIPLE-CONDUCTOR ELECTRICAL CONNECTOR AND STAMPED AND FORMED CONTACTS FOR USE THEREWITH

FIELD OF THE INVENTION

This invention generally relates to electrical connectors and, particularly, to a novel stamped and formed contact to facilitate gang-loading of the contacts, and which is readily adaptable for use with printed circuit boards having rows of staggered insertion holes.

BACKGROUND OF THE INVENTION

There are a wide variety of electrical connectors available which are adapted for mounting on a printed circuit board. The connectors have electrical contacts for terminating with appropriate conductors and for either surface mounting or solder tail mounting to the circuit traces on the printed circuit board.

With such electrical connectors, it is desirable to be able to gang-load the connectors with multiple contacts, such as contact strips wherein a plurality of contacts are joined by an integral carrier web. With ever-increasing miniaturization of electronic circuitry, it has become increasingly difficult to gang-load multiple contacts because of the spacing of the insertion holes in the printed circuit board. More particularly, the insertion holes often are arranged in rows through the printed circuit board. The closeness of the holes is limited because of the possibility of solder bridging between adjacent holes and shorting out the circuit. Consequently, it has become common to arrange rows of insertion holes in a staggered configuration. In other words, the holes of adjacent rows are not in a line but are alternatingly staggered along the line in transverse alignment.

These measures which are taken to prevent solder bridging and allow increased density on the printed circuit board create problems in connector design, particularly when it is desirable or necessary to gang-load multiple contacts. In other words, it can be understood that the contacts on a flat carrier strip are in a straight line whereas the insertion holes in the printed circuit board are staggered. One solution to this problem has been to mount contacts longitudinally in a connector housing, with the contacts in alternating transverse orientation so that their solder tails are alternatingly transversely spaced for insertion into the staggered printed circuit board holes. This requires specially designed tooling, multiple assembly steps or two different configurations of contacts, all of which is undesirable and costly. Another approach has been to stamp contacts out of flat sheet metal with each contact having two solder tails, one of which can be removed so that a selected solder tail can be inserted through the staggered holes in either of two rows of insertion holes in the printed circuit board. However, flat contacts do not serve the wider purposes of stamped and formed contacts, such as contacts which lock or retain the conductors, commonly termed "wire traps".

This invention is directed to solving the myriad of problems discussed above by providing a multi-conductor electrical connector which is capable of gang-loading a plurality of contacts and which is capable of termination in staggered holes in a printed circuit board.

SUMMARY OF THE INVENTION

An object, therefore, of the invention is to provide a new and improved multiple-conductor electrical connector having a novel stamped and formed contact and which is particularly adapted for mounting on a printed circuit board which includes two rows of staggered insertion holes.

In the exemplary embodiment of the invention, a multiple-conductor electrical connector is illustrated for gang-loading a plurality of contacts. The contacts are adapted for low insertion and high retention forces on the conductors, commonly termed "wire traps". Of course, features of the invention are readily applicable to other types of contacts independent of their insertion or retention capabilities.

The connector includes an insulating housing having an elongate cavity. A plurality of stamped and formed sheet metal contacts are mounted in a row in the cavity. Each contact includes an upstanding anvil portion at one side of the cavity and a spring finger portion at an opposite side of the cavity. In the exemplary embodiment, the spring finger portion is inclined in a manner whereby a conductor can be inserted into the cavity between the anvil portion and the spring finger portion with low insertion force, and the spring finger portion opposes withdrawal of the conductor from the cavity, or traps the conductor therein.

The invention contemplates that each contact is provided with a pair of terminal tails projecting through the housing from opposite sides of the cavity. The terminal tails are independently severable whereby a selected one of the tails can be disposed in a selected one of a pair of spaced contact lines on the housing. In use, the connector is particularly applicable for mounting on a printed circuit board which includes two rows of staggered insertion holes. Therefore, with the terminal tails being independently severable, a terminal tail of any contact can be inserted into a hole in either row of staggered insertion holes in the printed circuit board.

The invention also contemplates a feature wherein the terminal tails are stamped and formed out of the upstanding anvil and the spring finger portions of the contact at opposite sides thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
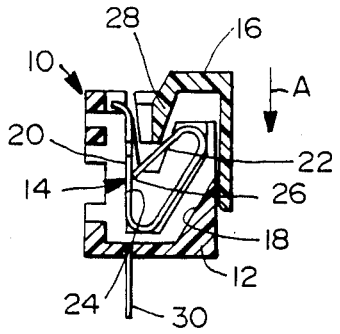
FIG.1 (PRIOR ART)
FIG. 1 is a vertical section through an electrical connector of the prior art.

Referring to the drawings in greater detail, and first to FIG. 1, an electrical connector, generally designated 10, in accordance with the prior art, is illustrated. The connector includes a housing 12, a stamped and formed contact, generally designated 14, and a cover 16. The housing has an elongate cavity 18 (elongated perpendicular to the figure) for receiving a plurality of contacts 14 in a line.

Each contact includes an upstanding anvil portion 20 and a spring finger portion 22. The anvil portion is rigidly backed by an interior wall 24 of cavity 18. Spring finger portion 22 is biased against anvil portion 22, at a point 26, for receiving a conductor therebetween to establish a two-point contact with the conductor. It can be seen that spring finger portion 22 is inclined upwardly and outwardly away from anvil portion 20 to trap the conductor in the connector. In other words, this configuration of contact provides for low insertion and high retention forces on the conductor. In order to withdraw the conductor, cover 16 is depressed in the direction of arrow "A" so that a flange 28 of the cover engages spring finger portion 22 to move the spring finger portion off of the conductor, away from anvil portion 20, and to release the conductor for easy withdrawal from the connector.

The prior art connector 10 of FIG. 1 includes a solder tail 30 which actually is an extension of anvil portion 20. This solder tail is provided for insertion through a hole in a printed circuit board. Connector 10, with elongated cavity 18, is designed to receive a plurality of contacts 14 lengthwise of the cavity whereby a plurality of solder tails 30 are arranged in a row (perpendicular to the figure) for insertion into a row or line of insertion holes in the printed circuit board.

As stated above, with increasing circuit miniaturization, many printed circuit boards are provided with staggered insertion holes in order to prevent solder bridging between the holes. It can be seen that electrical connectors of the prior art, such as connector 10 in FIG. 1, cannot be used with staggered-holed printed circuit boards. In addition, in the following description, it should be understood that the invention retains the capability of gang-loading a plurality of contacts of a contact strip into the connector.

Figure 2:
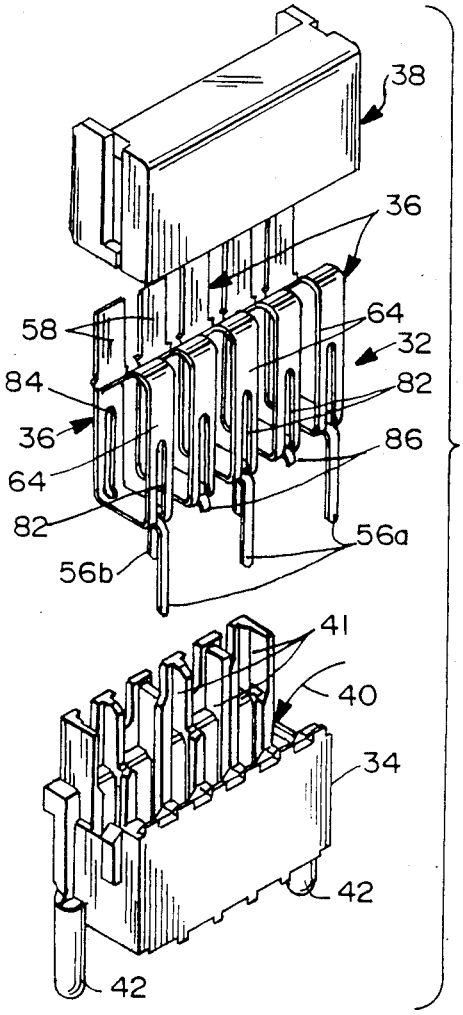
FIG. 2 is an exploded perspective view of the components of an electrical connector embodying the concepts of the invention.
Figure 3:
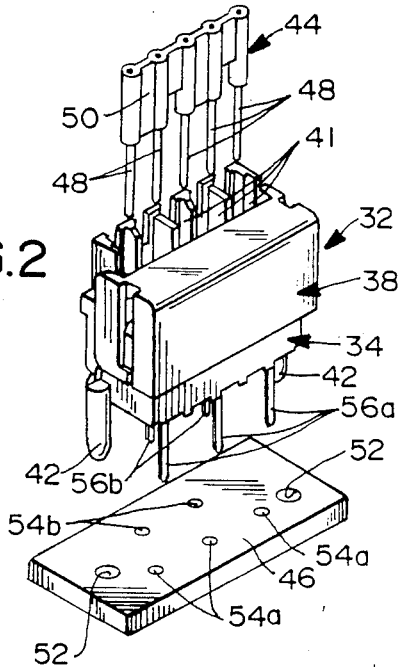
FIG. 3 is a perspective view of the electrical connector of FIG. 2, in assembled condition, and about to be terminated with a flat conductor strip, and about to be mounted to a printed circuit board.

FIGS. 2 and 3 show the basic components of an electrical connector, generally designated 32, incorporating the concepts of the invention. More particularly, connector 32 includes a housing, generally designated 34, a plurality of contacts, each generally designated 36, and a cover, generally designated 38. Housing 34 includes an elongate cavity illustrated by arrow 40 (FIG. 2). The contacts initially are part of a contact strip, described hereinafter, and are gang-loaded into cavity 40 in a single loading operation between partitions 41 which form separating cavities within elongate cavity 40. Housing 34 also has a pair of polarizing posts 42 for insertion through appropriate polarizing holes in a printed circuit board, as is known.

FIG. 3 shows connector 32 in assembled condition and in association with a flat conductor strip, generally designated 44, and a printed circuit board 46. The conductor strip is of conventional configuration and includes a plurality of wire conductors 48 joined in a flat, spaced configuration by an insulating web 50. Printed circuit board 46 includes polarizing holes 52 for receiving polarizing posts 42 depending from housing 34. The printed circuit board also has terminal insertion holes 54*a* and 54*b* for receiving solder tails 56*a* and 56*b*, respectively, from contacts 36 (FIG. 2) as described hereinafter. At this point, it should be noted that insertion holes 54*a* are in one line and insertion holes 54*b* are in a second line, with the holes in the two lines being staggered lengthwise thereof. Actually, the holes are of a normal board "line" but are staggered as shown. It also should be understood that these lines of holes could be much longer than illustrated in FIG. 3.

Figure 4:
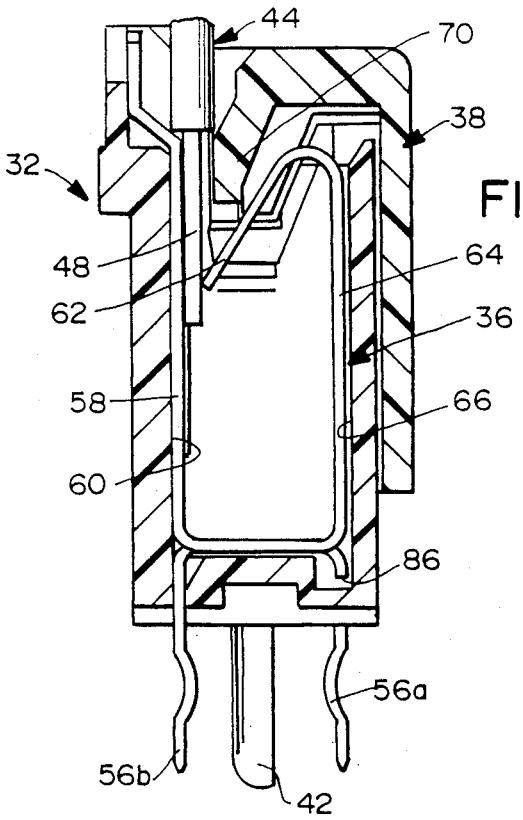
FIG. 4 is a vertical section, on an enlarged scale, of the assembled connector, terminated to the conductors.
Figure 5:
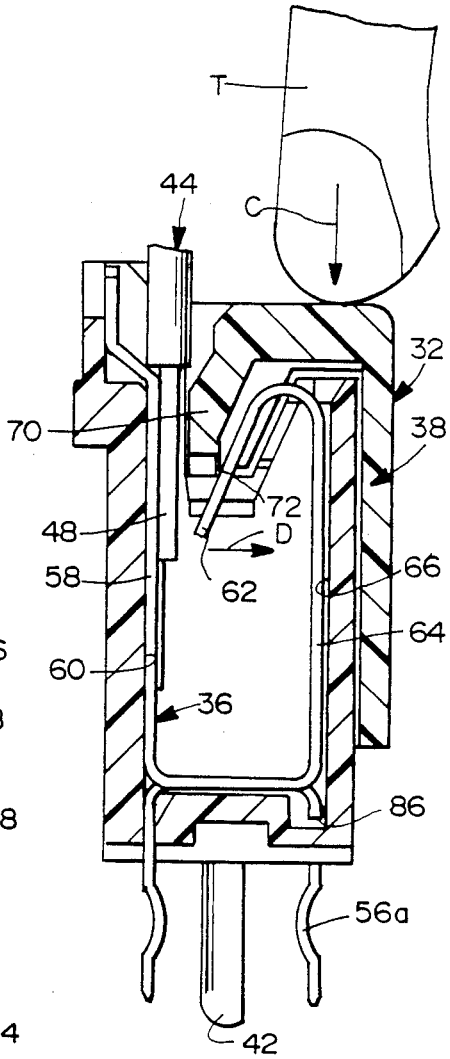
FIG. 5 is a view similar to that of FIG. 4, with the cover component of the connector being depressed to allow easy withdrawal of the conductors.

Referring to FIGS. 4 and 5 in conjunction with FIGS. 1 and 2, the precise location of each contact 36 within housing 34, and in relation to cover 38, is better illustrated. Somewhat similar to connector 10 in FIG. 1, each contact 36 includes an anvil portion 58 rigidly supported at one side of cavity 40 by a cavity side wall 60. The contact also has a spring finger portion 62 which is formed by bending back a distal end of an upstanding arm portion 64 located adjacent an opposite side wall 66 of cavity 40. Spring finger portion 62 is resiliently biased in the direction of arrow "B" against anvil portion 58 whereby a conductor 48 of flat conductor strip 44 can be inserted therebetween to establish a two-point contact on the conductor between the anvil portion and the spring finger portion of the contact.

As with the prior art connector 10 shown in FIG. 1, cover 38 is used to release and permit withdrawal of conductor 42 from the connector, as is shown in FIG. 5. More particularly, the cover is depressed in the direction of arrow "C", as by a user's finger or thumb "T", and an interior flange portion 70 of the cover engages spring finger portion 62, as at 72, to move the spring finger portion away from conductor 48, in the direction of arrow "D", and allow the conductor to be easily withdrawn from the connector. With a flat conductor strip, and with cover 38 being elongated as shown in FIGS. 2 and 3, the entire conductor strip can be withdrawn singularly in that flange 70 extends lengthwise of the connector for engaging all of the spring finger portions of the contacts simultaneously.

In order to provide for gang-loading of all of the contacts 36 into housing 34 simultaneously, and in order to provide for connection of the contacts with a staggered configuration of insertion holes in a printed circuit board as described in relation to FIG. 3, each contact 36 is provided with two solder tails 56*a* and 56*b*. It can be seen in FIGS. 4 and 5 that solder tail 56*a* is vertically aligned with arm portion 64 of the contact, and solder tail 56*b* is vertically aligned with anvil portion 58 of the contact. This spacing corresponds to the transverse spacing between insertion holes 54*a* and 54*b*, respectively, in printed circuit board 46 shown in FIG. 3.

Figure 6:
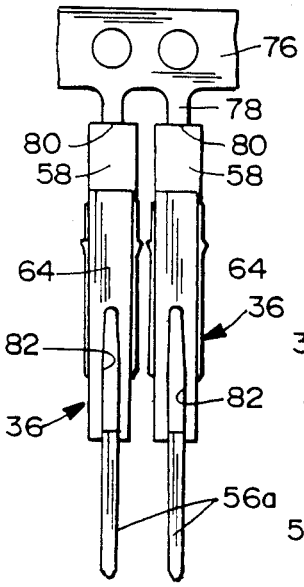
FIG. 6 is a fragmented elevational view of a contact strip for gang-loading a plurality of contacts in the connector.
Figure 7:
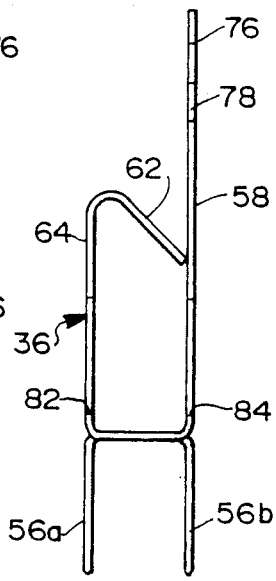
FIG. 7 is an end elevational view of the contact strip of FIG. 6.

In order to accomplish all of the functions described immediately above, reference is made to FIGS. 6 and 7 in conjunction with FIGS. 4 and 5. FIG. 6, particularly, shows that each contact 36 is stamped and formed from a contact strip which includes a continuous lengthwise carrier strip 76 joining the stamped and formed contacts thereto at appropriately spaced intervals by integral webs 78. Therefore, any desired number of contacts 36 can be gang-loaded into housing 34 between partitions 41. The partitions position and space the contacts. Once loaded, carrier strip 76 and webs 78 are readily severed from the contacts, as may be facilitated by providing scoring lines 80 (FIG. 6) to facilitate breaking the carrier strip and webs from the contacts.

The invention contemplates that each contact 36 be provided with two solder tails, specifically one each of solder tails 56*a* and 56*b*. This is shown in FIGS. 6 and 7. Solder tail 56*a* of each contact is stamped and formed out of an opening 82 in arm portion 64 which terminates in spring finger portion 62. Solder tail 56*b* is stamped and formed out of an opening 84 in anvil portion 58 of the contact.

Before gang-loading the contact strip into the connector housing, the configuration of the insertion holes in the printed circuit board is determined and one of the solder tails 56*a* or 56*b* is severed. This is shown at 86 in FIGS. 4 and 5. In other words, the contact which is fully shown in those figures has solder tail 56*b* retained for insertion into one of the holes 54*b* in printed circuit board 46. The other solder tail (56*a*) is severed at 86 because there is no corresponding hole in the opposite row (holes 54*a*) in the printed circuit board. FIGS. 4 and 5 show a depending solder tail 56*a* which can be seen projecting from the bottom of the connector as being behind the contact shown, as viewed in the drawings. This solder tail 56*a* is of the immediately adjacent contact behind the contact shown and is retained (with the other solder tail 56*b* removed) for insertion in one of the insertion holes 54*a* in the printed circuit board. The selected contacts can be made readily separable by providing a score line, as at 86, so that a user can simply snap the solder tails off of the remainder of the contacts, as desired. On the other hand, under mass production environments, a programmed separating or severing procedure can be incorporated in the manufacturing process for mounting the connector on printed circuit boards of known insertion hole configurations. Therefore, it can be seen that the invention accommodates varying printed circuit board insertion hole configurations while still providing a stamped and formed contact which can be gang-loaded into the connector housing, all of the contacts having an identical stamped and formed shape or configuration.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A multiple-conductor electrical connector adapted for low insertion and high retention forces on a conductor, comprising:

an insulating housing having a cavity; and a stamped and formed sheet metal contact mounted in the cavity and including an anvil portion at one side of the cavity and a spring finger portion at an opposite side of the cavity, the spring finger portion being inclined in a manner whereby a conductor can be inserted into the cavity between the anvil portion and the spring finger portion with low insertion force and the spring finger portion opposes withdrawal of the conductor from the cavity, the contact having a pair of terminal tails projecting through the housing from said opposite sides of the cavity, the terminal tails being independently severable whereby a selected one of the tails can be disposed in a selected one of a pair of spaced contact lines on the housing and wherein one of said terminal tails is stamped and formed out of the anvil portion of the contact.

2. The electrical connector of claim 1 wherein the other of said terminal tails is stamped and formed out of the spring finger of the contact.

3. The electrical connector of claim 1, including a cover for at least partially closing said cavity, the cover being movably mounted on the housing for movement against the spring finger portion of the contact to release the conductor for easy withdrawal.

4. For use in an electrical connector for mounting on a printed circuit board which includes two rows of staggered insertion holes, the connector including an insulating housing having elongate cavity means:

a contact strip having a continuous carrier with laterally extending stamped and formed contacts gang-mountable in the elongate cavity means of the housing, each contact including conductor receptacle means positionable in the cavity means and a pair of laterally spaced terminal tails projecting through the housing from the cavity, and the terminal tails being independently severable whereby a terminal tail of any contact can be inserted into a hole in either row of staggered insertion holes in the printed circuit board.

5. The contact strip of claim 4, in combination with a cover movably mounted on the housing for movement into engagement with the spring finger contact portion to move the spring finger contact portion out of engagement with the conductor and thereby allow for ready withdrawal of the conductor from the connector.

6. The contact strip of claim 4 wherein said receptacle includes an anvil contact portion and a spring finger contact portion for receiving a conductor therebetween.

7. The contact strip of claim 6 wherein one of said terminal tails is stamped and formed out of the anvil contact portion of the contact.

8. The contact strip of claim 6 wherein one of said terminal tails is stamped and formed out of the spring finger contact portion of the contact.

9. The contact strip of claim 8 wherein one of said terminal tails is stamped and formed out of the anvil contact portion of the contact.

10. A stamped and formed contact for use in an electrical connector for mounting on a printed circuit board which includes irregularly spaced insertion holes, comprising:

receptacle means for receiving a conductor, the receptacle means including an anvil portion and a spring finger portion, a pair of spaced terminal tails independently severable for selective insertion into a selected hole in the printed circuit board, one of the terminal tails being stamped and formed out of the anvil portion of the contact, and the other of the terminal tails being stamped and formed out of the spring finger portion of the contact.

11. A multi-conductor electrical connector for mounting on a printed circuit board which includes two rows of staggered insertion holes, comprising:

an insulating housing having elongate cavity means; and a contact strip having a continuous carrier with laterally extending stamped and formed contacts gang-mountable in the elongate cavity means of the housing, each contact including an anvil portion at one side of the cavity means and a spring finger portion at an opposite side of the cavity means for receiving a conductor inserted into the cavity means between the anvil portion and the spring finger portion to provide a two-point contact therewith, the contact having a pair of terminal tails projecting through the housing from said opposite sides of the cavity, the terminal tails being independently severable whereby a terminal tail of any contact can be inserted into a hole in either row of staggered insertion holes in the printed circuit board, and wherein one of said terminal tails is stamped and formed out of the spring finger portion of the contact.

12. The multi-conductor electrical connector of claim 11 wherein the other of said terminal tails is stamped and formed out of the anvil portion of the contact.

13. The contact strip of claim 11 in combination with a cover movably mounted on the housing for movement into engagement with the spring finger portion to move the spring finger portion out of engagement with the conductor and thereby allow for ready withdrawal of the conductor from the connector.

* * * * *